US005866991A

United States Patent [19]

Farkas et al.

[11] Patent Number: 5,866,991

[45] Date of Patent: Feb. 2, 1999

[54] INDUCTION LAMP WITH OPPOSITELY ORIENTED COIL WINDING LAYERS

[75] Inventors: Thomas Farkas, Guilderland, N.Y.; Timothy A. Taubert, Kirtland, Ohio; George A. Farrall, Rexford, N.Y.; Gordon A. Grigor, Cleveland Heights, Ohio; David O. Wharmby, Ilkley, United Kingdom

[73] Assignee: General Electric Company, Schenectady, N.Y.

[21] Appl. No.: 672,220

[22] Filed: Jul. 17, 1996

[51] Int. Cl.[6] ..... H05B 41/24

[52] U.S. Cl. ..... 315/248; 315/344; 313/153; 313/154; 313/161

[58] Field of Search ..... 315/248, 283, 315/344; 313/161, 493, 153, 154

[56] References Cited

U.S. PATENT DOCUMENTS

| | | | |
|---|---|---|---|
| 4,171,503 | 10/1979 | Kwon | 315/248 |
| 4,727,294 | 2/1988 | Houkes et al. | 315/248 |
| 4,977,354 | 12/1990 | Bergervoet et al. | 315/248 |
| 5,349,271 | 9/1994 | Van Os et al. | 315/248 |
| 5,387,850 | 2/1995 | Bray et al. | 315/248 |

FOREIGN PATENT DOCUMENTS

| | | | |
|---|---|---|---|
| 0 594 245 A1 | 4/1994 | European Pat. Off. . | |
| 0066854 | 5/1980 | Japan | 315/248 |

*Primary Examiner*—Arnold Kinkead
*Attorney, Agent, or Firm*—Charles E. Bruzga

[57] ABSTRACT

An electrodeless gas discharge lamp includes a vitreous envelope containing a discharge medium. An excitation coil is positioned in relation to the vitreous envelope so as to excite the discharge medium therein. The excitation coil is adapted to be driven by an RF oscillator. The excitation coil has first and second ends and is effective for exciting the discharge medium to emit light with electromagnetic fields that are generated by the excitation coil. The excitation coil includes a first wire wound generally helically from the first end to the second end in a first helical direction to form first winding turns, and further includes a second wire wound generally helically from the first end to the second end in second helical direction opposite to that of the first helical direction to form second winding turns. Preferably, a generally cylindrical former is provided for holding the first and second wires between the first and second ends of the coil. Such former includes a positioning arrangement for maintaining specific positions of the first and second wires with respect to each other along the former.

16 Claims, 12 Drawing Sheets

INDUCTION LAMP WITH OPPOSITELY ORIENTED COIL WINDING LAYERS

FIELD OF THE INVENTION

The present invention relates to electrodeless discharge lamps, and more particularly, to the winding configuration that form a radio frequency coil used to excite a discharge medium with electromagnetic fields so as to emit light.

BACKGROUND OF THE INVENTION

Induction lamps are electrodeless lamps that typically include a vitreous envelope containing a discharge medium, with the envelope being shaped for operation with an electrical excitation coil. The excitation coil excites the discharge medium to emit light through the induction of electric current in the discharge medium. A principal issue in the design of an induction lamp is the electromagnetic interference (EMI) resulting from the large, high-frequency voltages on the windings of the excitation coil with respect to earth ground. EMI currents flow through stray capacitance between the high voltage windings and earth ground, either directly or via series capacitances including the discharge medium or conductive surfaces employed in the lamp.

One approach to reducing EMI of the foregoing type is to form a conductive coating over the vitreous envelope of an induction lamp, which is then coupled to radio frequency (RF) ground or to some other part of the power supply, or ballast, circuit. While a conductive coating is effective at reducing the noted type of EMI, it requires additional material and manufacturing steps, making the product more costly. It would, therefore, be desirable to provide an induction lamp which, at least in some cases, achieves a tolerable EMI level without the use of a conductive coating on the vitreous envelope of the lamp or other form of shielding. It would be further desirable to provide an additional means of reducing the level of EMI of the noted type in an induction lamp.

OBJECTS AND SUMMARY OF THE INVENTION

Accordingly, an object of the invention is to provide an induction lamp which, at least in some cases, achieves a tolerable EMI level without the use of a conductive coating on the vitreous envelope of the lamp or other (e.g. external) shielding of the lamp.

A further object of the invention is to provide an additional means of reducing the EMI currents that flow due to stray capacitance between the high voltage excitation coil of an induction lamp and earth ground.

In accordance with a preferred form of the invention, the present invention provides an electrodeless gas discharge lamp including a vitreous envelope containing a discharge medium. An excitation coil is positioned in relation to the vitreous envelope so as to excite the discharge medium therein. The excitation coil is adapted to be driven by an RF oscillator. The excitation coil has first and second ends and is effective for exciting the discharge medium to emit light with electromagnetic fields that are generated by the excitation coil. The excitation coil includes a first wire wound generally helically from the first end to the second end in a first helical direction to, form first winding turns, and further includes a second wire wound generally helically from the first end to the second end in second helical direction opposite to that of the first helical direction to form second winding turns. Preferably, a generally cylindrical former is provided for holding the first and second wires between the first and second ends of the coil. Such former includes positioning means for maintaining specific positions of the first and second wires with respect to each other along the former.

BRIEF DESCRIPTION OF THE DRAWINGS

In the following detailed description, reference will be made to the attached drawings in which like reference numerals refer to like, or corresponding elements, throughout the following figures, and in which.

DETAILED DESCRIPTION OF THE PREFERRED EMBODIMENTS

Figure 1:
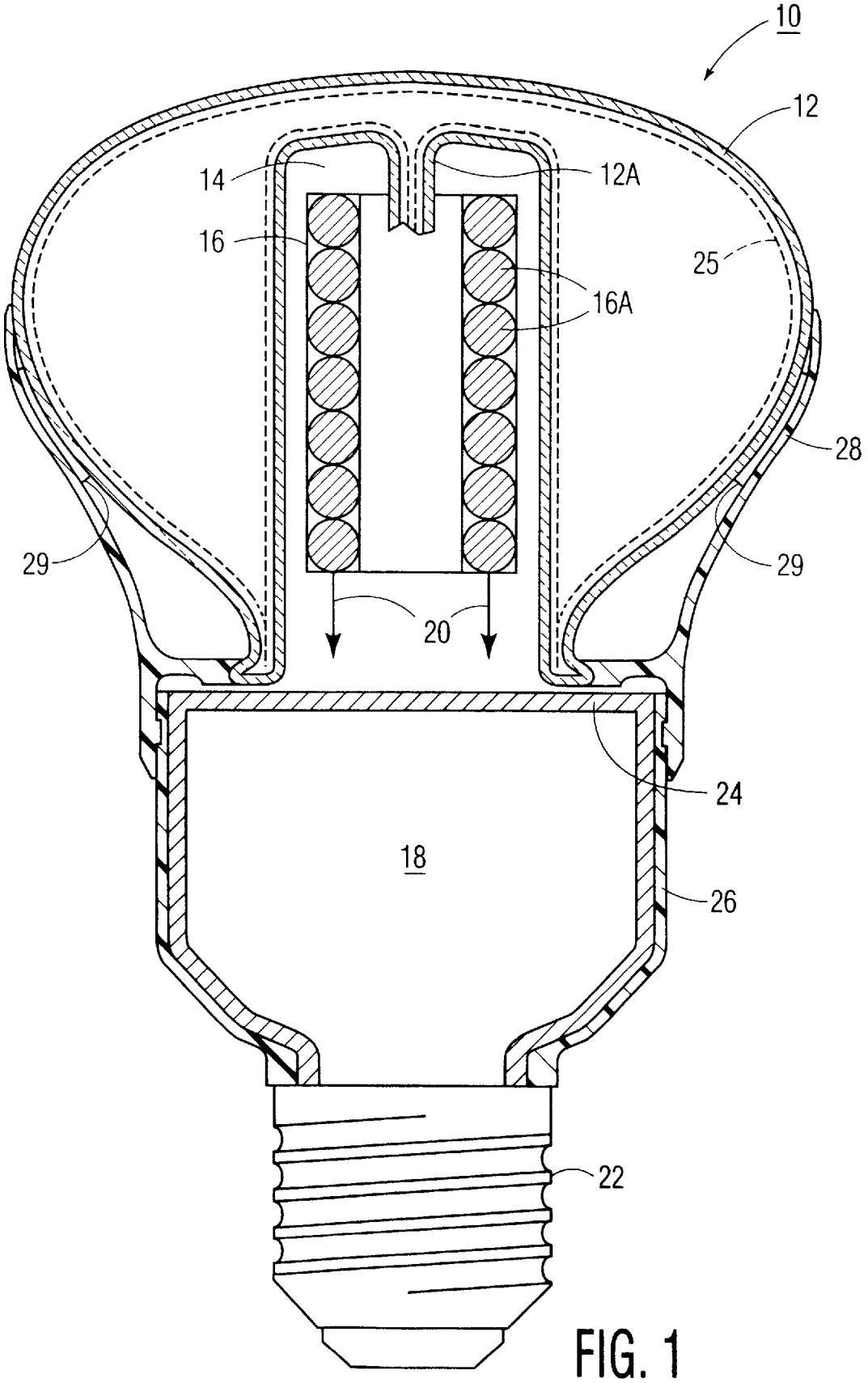
FIG. 1 is a simplified view of an electrodeless lamp, partially in cross section and partially cut away.

FIG. 1 is a simplified view of an electrodeless lamp 10 shown partially in cross section and partially cut away. Lamp 10 includes a vitreous envelope 12, such as soda-lime-silicate glass, that is hermetically sealed and that contains a discharge medium(or plasma), such as mercury and an inert gas such as argon. Vitreous envelope 12 is shaped with an external chamber 14 for receiving an electrical excitation coil 16. Coil 16, shown in simplified form, includes coil turns 16A whose cross sections are shown exaggerated in size. Coil 16 has a cylindrical shape, and a hollow interior through which stem 12A (shown partially cut away) of vitreous envelope 12 may extend. Coil 16 is electrically coupled to power supply, or ballast, circuit 18 via conductors 20, only part of which are shown; ballast circuit 18 is shown in schematic form as merely a block. Ballast circuit 18, in turn, is coupled to receive a.c. power from electrical supply mains via a screw-type base 22. A conductive shield 24 typically surrounds much of ballast circuit 18 for EMI-suppressing purposes. Conductive shield 26 is covered by a plastic housing 26, while the lower part of vitreous envelope 12 may be covered by a plastic skirt 28.

Excitation coil 16 generates high frequency electromagnetic fields for exciting the discharge medium within envelope 12 to produce light. Where mercury is employed within envelope 12, ultraviolet light is generated, which is then transformed into visible light through interaction with a conventional coating system 25 on the interior of envelope 12. Coating system 25, shown as a dashed line, typically includes phosphor, and may include a reflecting coating for focusing light generally upwards as viewed in FIG. 1.

A conductive loop 29 as shown in FIG. 1 may be used to reduce the sensitivity of the power of the lamp to various types of lamp fixtures which may be used.

Figure 2:
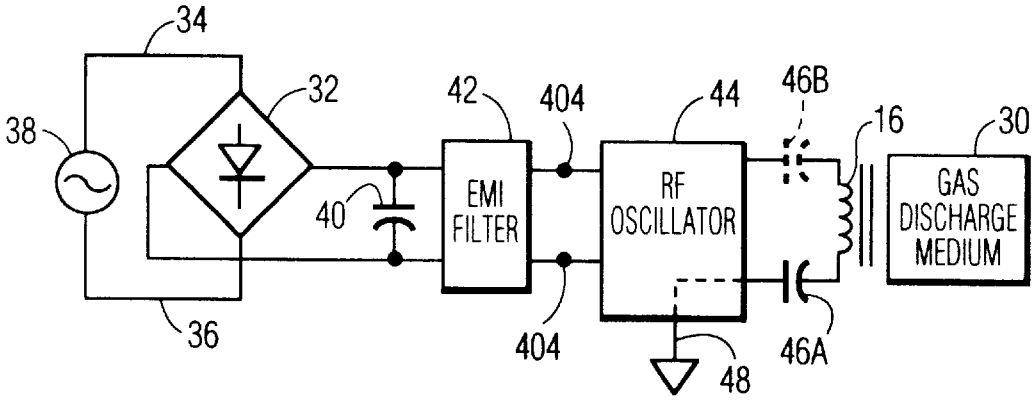
FIG. 2 is a schematic diagram, partially in block form, of an electrical circuit for powering a radio frequency (RF) coil shown in FIG. 1.

FIG. 2 shows an electrical circuit for powering RF coil 16 of FIG. 1 for exciting a gas discharge medium 30 within the lamp to produce light. A full-wave bridge rectifier 32 of the p-n diode type, for example, or another type of a.c.-to-d.c. converter, is supplied with power by main 34 and 36 from an a.c. power source 38. Rectified current from bridge rectifier 32 is smoothed by a capacitor 40 and passed through an electromagnetic interference (EMI) filter 42, which may comprise a conventional inductor-capacitor filter network. An RF oscillator 44 provides high frequency (e.g. 2.5 Megahertz) current to RF coil 16.

A d.c. blocking capacitor 46A may be placed between an RF ground 48 and the lower end of coil 16 as shown. Alternatively, a d.c. blocking capacitor 46B, shown in phantom, may be placed between the non-grounded output of RF oscillator 44 and the upper end of coil 16 as shown.

The electrical circuit of FIG. 2 is typical for a low power factor system. Obvious modifications would be made to adapt the circuit for a high power factor system.

Figure 3:
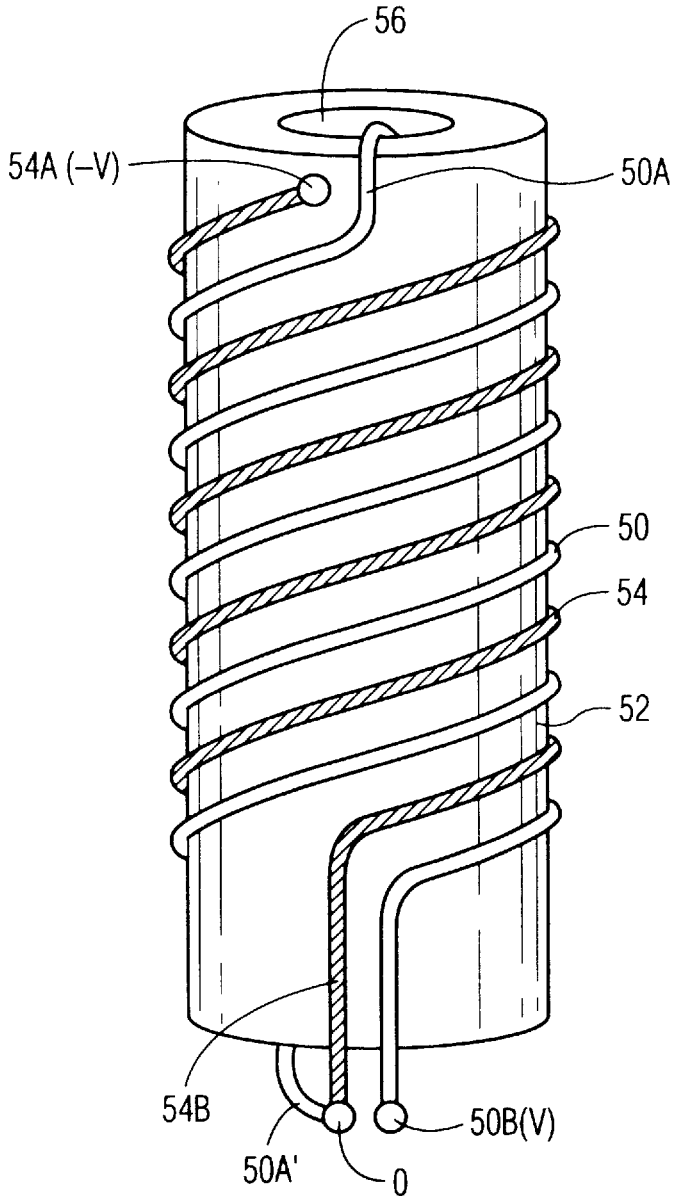
FIG. 3 PRIOR ART
FIG. 3 shows a prior art configuration in simplified form of an RF excitation coil.

Before describing the coil configuration in accordance with the invention, a prior art coil configuration is shown in simplified form in FIG. 3. Wire 50, shown in solid lines, is wound in one helical direction about a former 52 from top to bottom. Wire 54, shown with a diagonal hatching for convenience, is wound in the same helical direction about former 52 from top to bottom, and is typically referred to in the art as a parasitic winding. Upper end 50A of wire 50 is connected through a center 56 of former 52 to a lower end 50A' of wire 50, which is typically at a potential of0 volts, e.g., at RF ground 48 (FIG. 2). Lower end 54B of wire 54 is at the same potential as end 50A', e.g., at "0" volts. Lower end 50B of wire 50 is shown at the instantaneous potential of V volts, e.g., at the upper end of coil 16 in FIG. 2; however, wire ends 50A' and 54B are sometimes connected to a d.c. blocking capacitor, e.g., 46A in FIG. 2. With good coupling between the two windings, the upper end 54A of wire 54 is at the instantaneous potential of −V volts, and is typically left floating, i.e., unconnected to conductors at other circuit potentials; for this reason, it is referred to as a parasitic winding.

Figure 4:
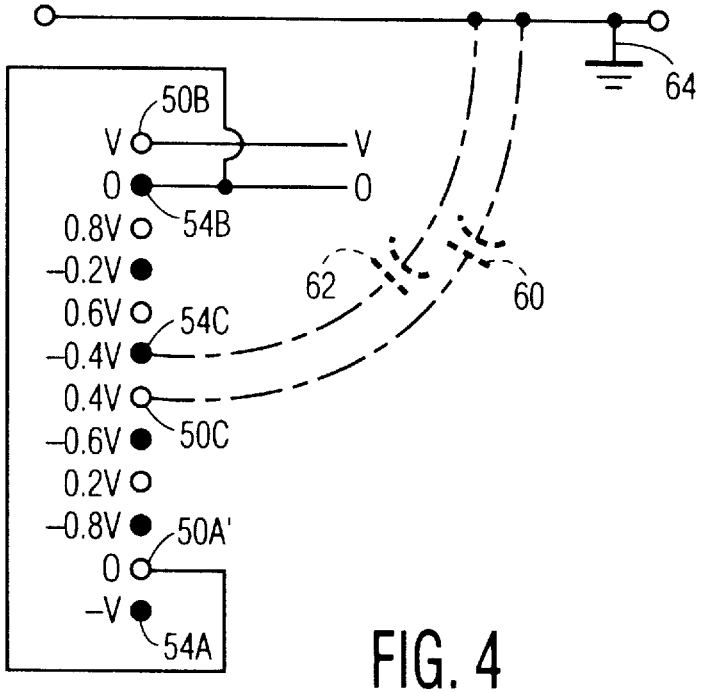
FIG. 4 PRIOR ART
FIG. 4 is a spatial diagram of circuit potentials at different points along the wires forming the prior art coil shown in FIG. 3.

FIG. 4 shows a spatial diagram of circuit potentials at different points along wires 50 and 54 forming the prior art coil of FIG. 3. FIG. 4 shows cross sections for wire 50 as circles and cross sections for wire 54 as solid dots. Ends 50A', 50B, 54A and 54B of wires 50 and 54 represent the like-numbered wire ends in FIG. 3. As can be appreciated from FIG. 4, adjacent winding turns 50C and 54C of wires 50 and 54 are at equal, but 180° out-of-phase, potentials of 0.4 V volts and −0.4 V volts, respectively. Now, considering parasitic capacitances 60 and 62 (shown in phantom) from winding turns 50C and 54C, respectively, to schematically shown earth ground 64, the respective currents from winding turns 50C and 54C will effectively cancel each other, thereby minimizing the net EMI current from those windings turns to earth ground 64. However, for adjacent winding turns above and below turns 50C and 54C, EMI current through parasitic capacitances to earth ground (not shown) are not likely to cancel each other. At the bottom of the winding, for example, wire end 50B is at V volts potential, whereas adjacent wire end 54B is at 0 volts potential. A similar mismatch between adjacent winding turns exists at the top of the coil as well, with the mismatch becoming smaller towards the vertical center of the coil. More particularly, adjacent turns have a net, or averaged, potential that is equal and opposite to that of a pair of turns on the other half of the coil an equal distance away from the center of the coil.

For the winding configuration of the prior art coil shown in FIG. 3 to achieve ideally perfect EMI suppression, the capacitive coupling (e.g., 60, 62, FIG. 4) to earth ground (64, FIG. 3) would need to be the same for positions along the coil that are equal distances away from the center of the coil. Such a condition cannot be achieved practically due to the typical asymmetry of the lamp and its environment as affects the path of capacitive coupling from points of the coil to earth ground.

Figure 5:
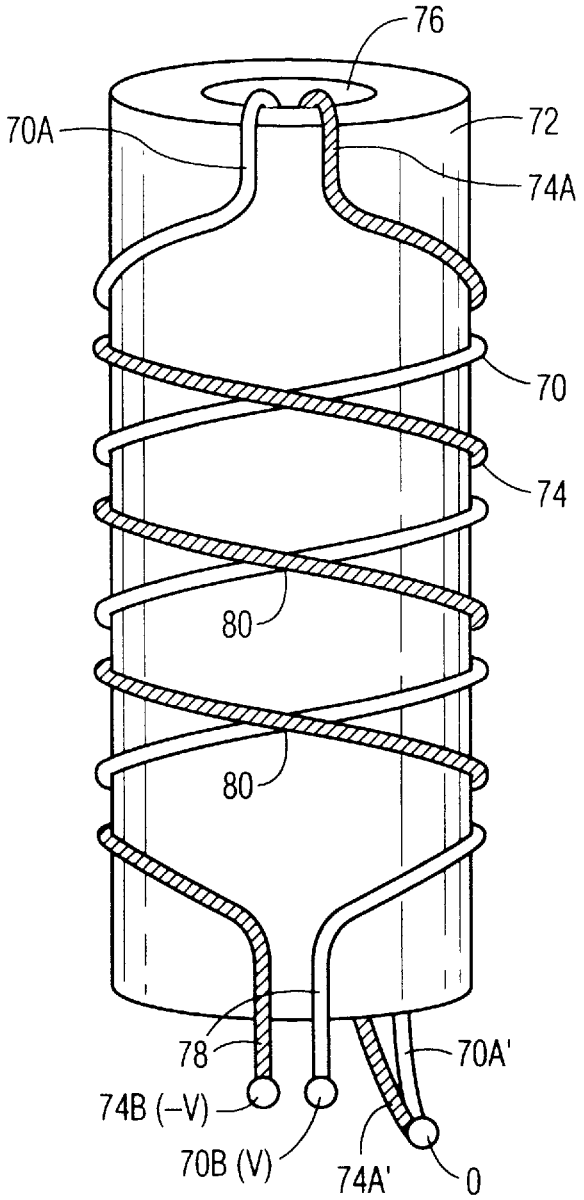
FIG. 5 is a configuration in simplified form for an RF excitation coil in accordance with the present invention.

In order to minimize the net EMI current resulting from the parasitic capacitances to earth ground in the prior art coil of FIGS. 3 and 4, the present invention provides the coil shown schematically in FIG. 5. In FIG. 5, wire 70 is wound helically in one direction from top to bottom of former 72. Meanwhile, wire 74, shown with diagonal hatching for convenience, is wound about former 72 from top to bottom in the opposite direction from the helical winding of wire 70. Upper ends 70A and 74A of wires 70 and 74 may, if desired, be connected through a center 76 of former 72 to lower ends 70A' and 70B', which, in turn, are connected together at the same potential typically of0 volts, e.g., at RF ground 48 (FIG. 2). Referring to FIG. 2, this is because the lower wire ends 70A' and 74A' are typically connected directly to RF ground 48, with d.c. capacitor 46B being used rather than d.c. blocking capacitor 46A. Alternatively, upper ends 70A and 74A could be connected to the lower ends 70A' and 74A' by wires (not shown) that are routed outside of former 72. Lower end 70B of wire 70 is at the potential of V volts, e.g., at the upper shown end of coil 16 shown in FIG. 2. Meanwhile, lower end 74B of wire 74 is at the potential of −V due to the near unity coupling between wires 70 and 74, and may be left floating if desired. For maximum EMI reduction, portions 78 of wires 70 and 74 that lead from the helically wound portions of such wires to termination ends 70B and 74B are extended as long as necessary and positioned as close together as possible.

Figure 6:
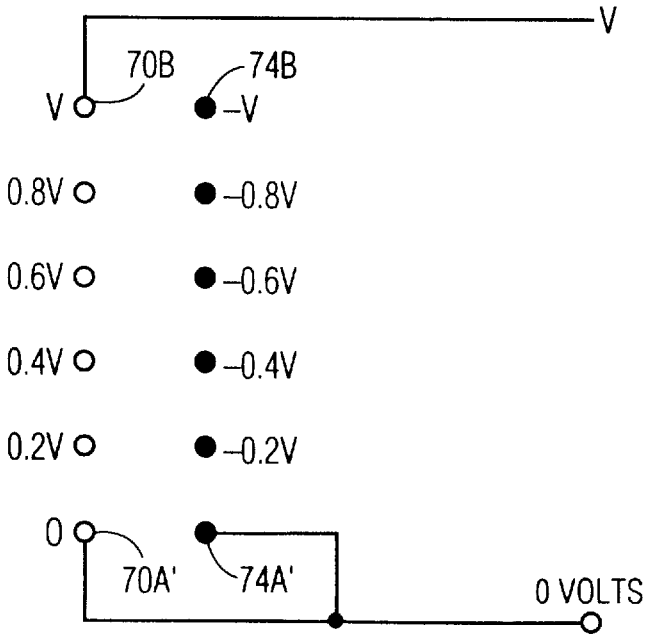
FIG. 6 is a spatial diagram of circuit potentials at different points along the wires forming the inventive coil of FIG. 5.

FIG. 6 shows a spatial diagram of circuit potentials at different points along wires 70 and 74 forming the inventive coil of FIG. 5. FIG. 6 shows the cross sections for wire 70 as circles and the cross sections for wire 74 as solid dots. Ends 70A', 70B, 74A' and 74B of wires 70 and 74 represent the like-numbered wire ends in FIG. 5. As can be seen in FIG. 6, horizontally adjacent wire turns have equal (or approximately equal), but 180° out-of-phase, voltages on them. This is true over the entire vertical distance of the coil. Consequently, the EMI currents through the parasitic capacitances from horizontally adjacent winding turns to earth ground, corresponding to capacitances 60 and 62 discussed above with respect to FIG. 4, effectively cancel each other so as to minimize the net EMI current to earth ground.

It has been found that using the inventive winding of FIGS. 5 and 6 has enabled such a reduction in EMI as to obviate, in some cases, the need to coat envelope 12 (FIG. 1) with a conductive layer (not shown) that is coupled to RF ground or another circuit potential. Thus, one example used as a reference a 23-watt electrodeless lamp, a prior art winding as shown in FIG. 3, capacitor 46B (FIG. 2), conductive loop 29 (FIG. 1), and a conductive coating on the lamp envelope as mentioned above. In comparison, the inventive coil of FIG. 5 was used in the same type of lamp but without a conductive coating on the lamp envelope, and employed conductive loop 29 (FIG. 1) and capacitor 46A (FIG. 2). The inventive coil exhibited a meager 0.6 decibel-microvolts increase in the peak, conducted EMI level, and still met the relevant regulatory standard.

As will be appreciated from the spatial diagram of FIG. 6, adjacent turns of the inventive winding in the upper half of the winding will require dielectric separation to support a voltage difference reaching 2V volts at the top of the winding; at the bottom of the winding, considerably less dielectric separation is required. In comparison, a maximum voltage difference of V volts is reached in the prior art coil shown in FIG. 4. Dielectric separation may be achieved with the inventive coil of FIGS. 5 and 6, for instance, by winding inner layer 70 first, and applying a vertical strip of dielectric tape over the portions, e.g., 80 (FIG. 5) of inner layer 70 which will be overlain by portions of outer winding layer 74.

Figure 7A:
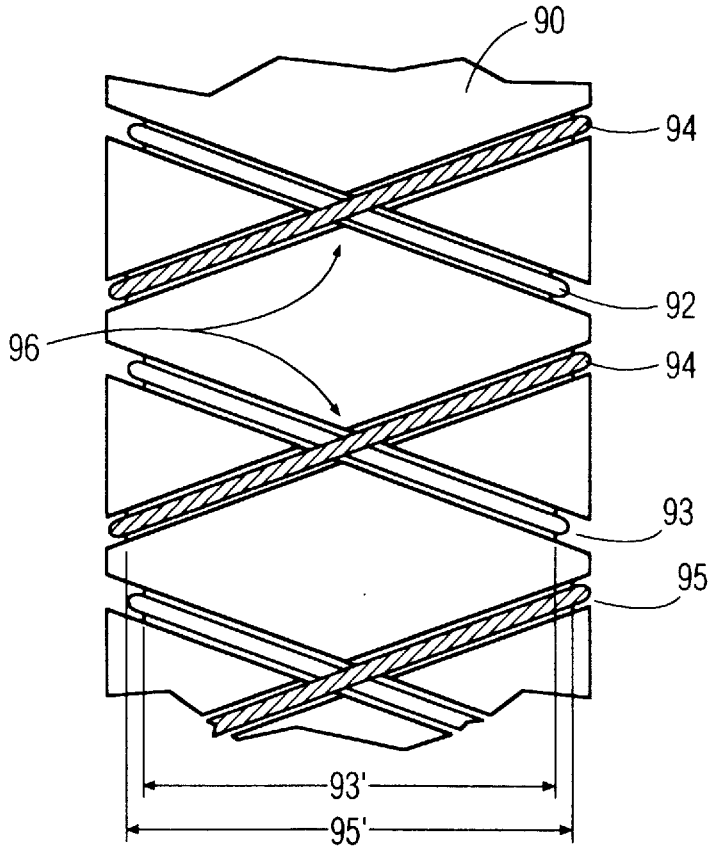
FIG. 7A is a side view of a portion of an inventive coil wound on a former to achieve specific positioning of an inner wire with respect to an outer wire.

FIG. 7A shows a side view of a portion of an inventive coil wound on a former 90 which may be made of a high temperature plastic, such as a liquid crystal polymer, and which may comprise a ferro-magnetic material such as ferrite. Former 90 serves to specifically position inner wire 92 with respect to outer wire 94, shown with diagonal hatching for convenience. This maximizes the above-described EMI cancellation effect between adjacent windings by positioning the adjacent winding turns with approximately equal, but 180° out-of-phase, voltages next to each other.

As shown in FIG. 7A, wire 92 is wound in groove 93 about former 90. Wire 94 is wound in groove 95 about former 90. Dimensions 93' and 95' of grooves 93 and 95, respectively, may be chosen so that outer wire 94 is sufficiently spaced from inner wire 92 at locations (e.g. 96) where the wires cross each other, to provide reliable dielectric separation between the wires at points 96 where they cross each other..

Figure 7B:
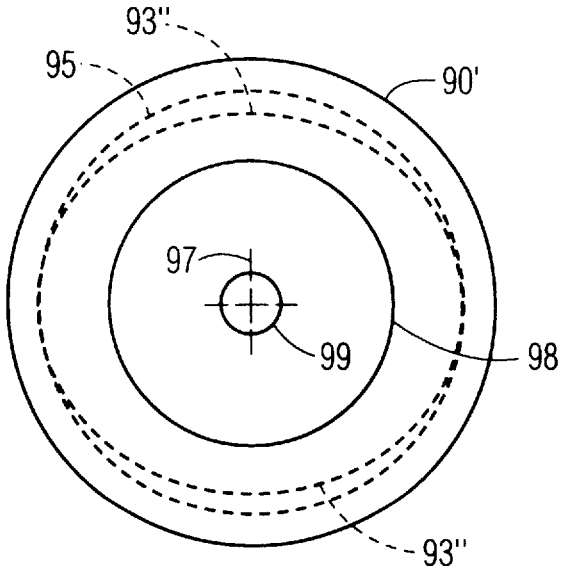
FIG. 7B is a simplified sectional view of a modification to the former of FIG. 7A.

FIG. 7B shows a simplified sectional view of a modified former 90'. Of particular note is that grooves 93" and 95 are of the same depth for much of their length around former 90'. However, at the top and bottom of the former as shown in the figure, groove 93" is deeper than groove 95 to allow inner wire 92 (FIG. 7A) in groove 93" to pass beneath outer wire 94 (FIG. 7A) in groove 95. In this embodiment, after inner wire 92 (FIG. 7A) is wound onto former 90', insulation such as TEFLON-brand synthetic resin that is sintered in place could be disposed on the portions of such inner wire at junction points 96 (FIG. 7A) with outer wire 94 to provide dielectric insulation between the wires. This embodiment benefits from maintaining more of the horizontally adjacent portions of wires 92 and 94 at the same radial distance from an axial center 97 of former 90'. This serves to maximize EMI reduction in the inventive manner described above.

FIG. 7B also shows the use of a core 98 of ferro-magnetic material, which may have a hollow center 99. This is an alternative to forming bobbin 90" of magnetic material, or forming it solely of non-magnetic material.

Figure 8A:
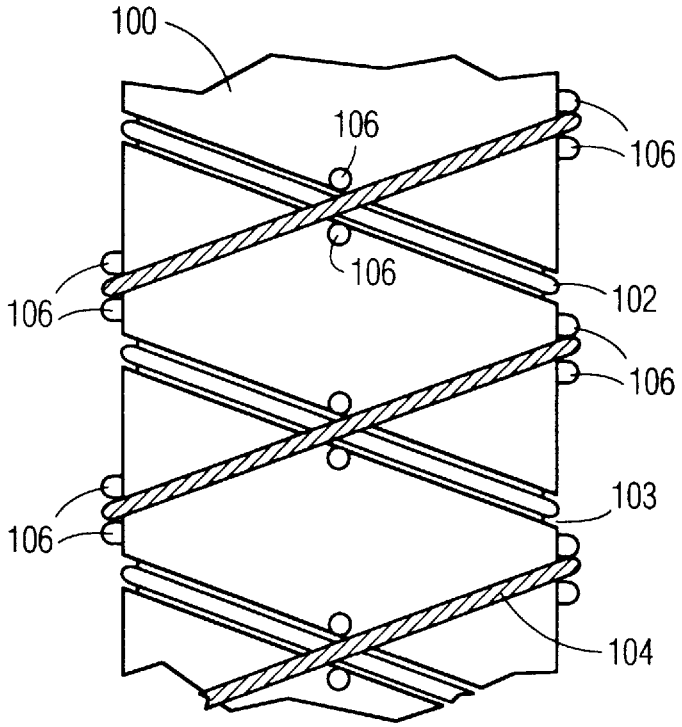
FIGS. 8A and 8B are simplified side plan and top views, respectively, of an inventive coil wound on a former in accordance with another embodiment of the invention.
Figure 8B:
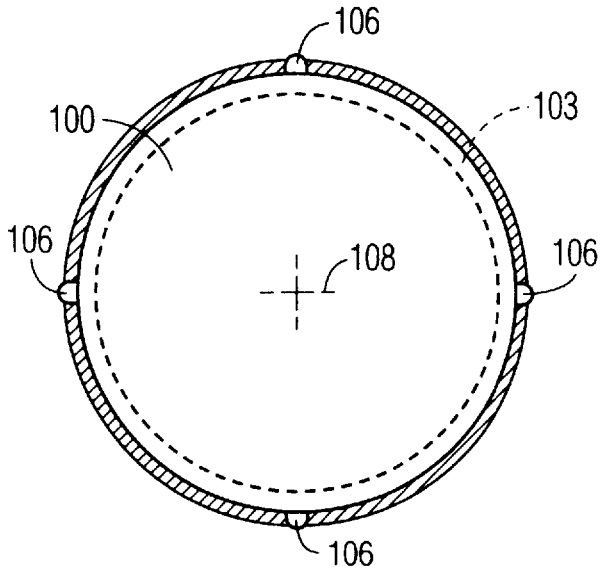

FIGS. 8A and 8B respectively show side plan and top views of a portion of another former 100 on which wires 102 and 104 may be wound in accordance with the invention. Wire 102 is wound in groove 103, whereas wire 104 (shown with diagonal hatching for convenience) is wound on the radial periphery of the former. Preferably, respective pairs of guide projections 106 extend outwardly from an interior 108 of the former so as to guide the portions of wire 104 that pass through them. This maximizes the above-described EMI cancellation effect between adjacent windings by positioning the adjacent winding turns with approximately equal, but 180° out-of-phase, voltages next to each other.

Further, the depth of groove 103 may be chosen to assure that outer wire 104 is sufficiently spaced from inner wire 102, thereby providing reliable dielectric separation between the wires.

Figure 9A:
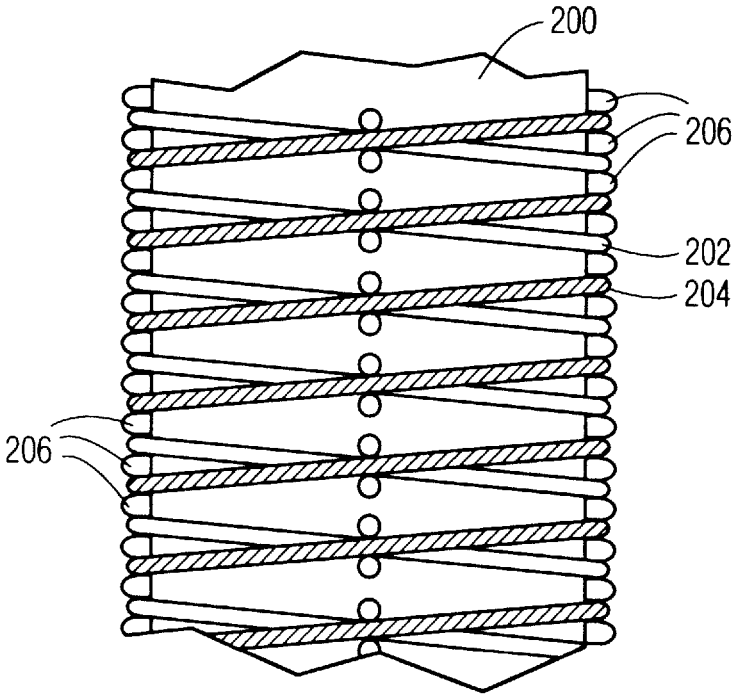
FIGS. 9A and 9B are simplified side plan and top views, respectively, of an inventive coil wound on a former in accordance with a still further embodiment of the invention.
Figure 9B:
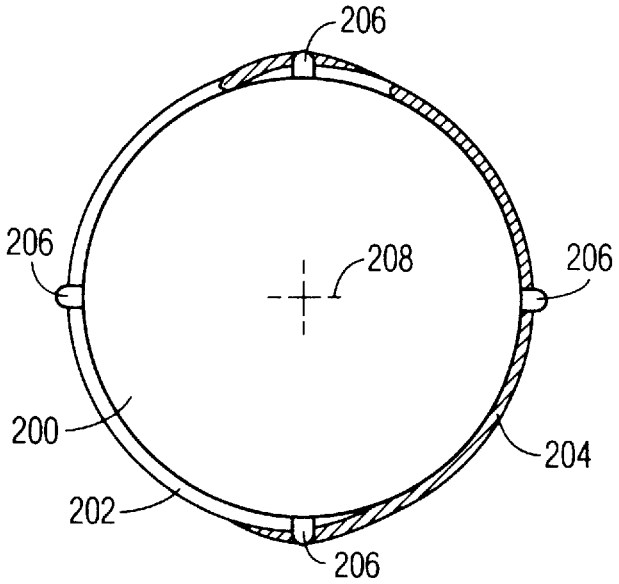

FIGS. 9A and 9B respectively show side plan and top views of a portion of another former 200 on which wires 202 and 204 may be wound in accordance with the invention. Wire 204 is shown with diagonal hatching for convenience. In this embodiment, guide projections 206 extend outwardly from an interior 208 of former 200 for guiding wires 202 and 204. Respective pairs of adjacent guide projections 206 guide the portions of the wire that pass through them. Guide projections 206 position the adjacent winding turns or wires 202 and 204 with approximately equal, but 180° out-of-phase, voltages next to each other, to maximize the above-described EMI-cancellation effect. However, dielectric separation between wires 202 and 204 will typically be provided by insulation on the wires, rather than inter-wire spacing as is possible with the embodiment of FIGS. 7A and 7B or the embodiment of FIGS. 8A and 8B, which both utilize a groove for the inner wire.

The embodiment of FIGS. 9A and 9B, like the embodiment of FIG. 7B, also benefits from maintaining more of the horizontally adjacent portions of wires 202 and 204 at the same radial distance from an axial center 208 of former 200.

Figure 10:
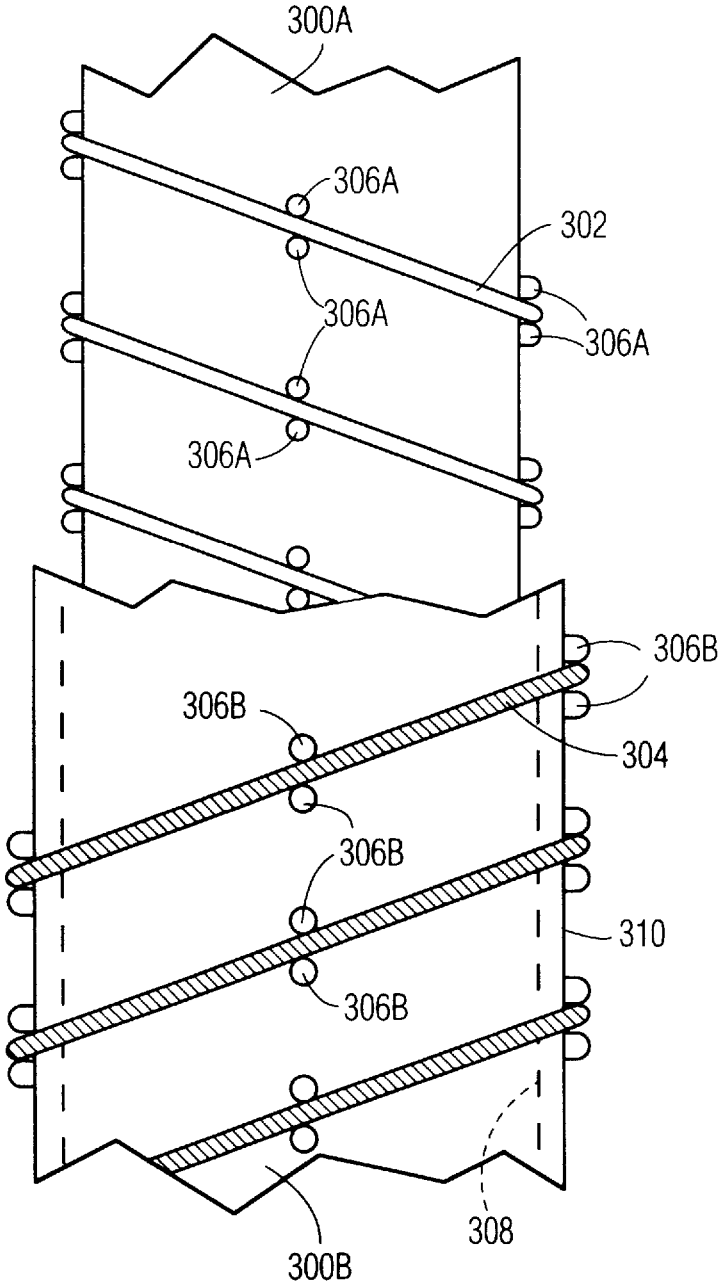
FIG. 10 shows a side plan view of an inventive coil wound on a two-part former in accordance with yet another embodiment of the invention.

FIG. 10 shows a side plan view of a two-part former 300A and 300B on which wires 302 and 304 may be respectively wound. Wire 304 is shown with diagonal hatching for convenience. Former portion 300A is provided with guide means such as projections 306A for positioning wire 302 along the vertical length of such former portion. Similarly, former portion 300B is provided with guide means such as projection 306B for positioning wire 304 along the vertical length of such former portion. Former portion 300A is adapted to fit within inner periphery 308 of former portion 300B, so that inner wire 302 and outer wire 304 are positioned in the relation of corresponding wires 102 and 104 in FIG. 8A. In this embodiment, wall 310 of former portion 300B provides easily controllable dielectric separation between wires 302 and 304.

Figure 11A:
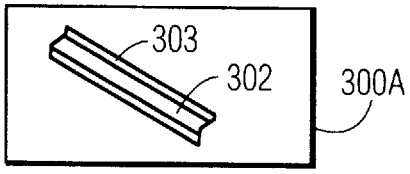
FIGS. 11A and 11B diagrammatically show in block form different wireguide means that can be used on the inner former member of FIG. 10.
Figure 11B:
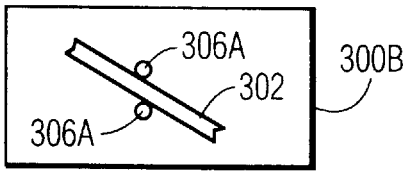
Figure 11C:
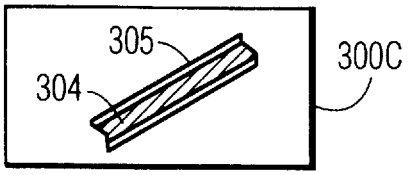
FIGS. 11C and 11D diagrammatically show in block form different wireguide means that can be used on the outer former member of FIG. 10.
Figure 11D:
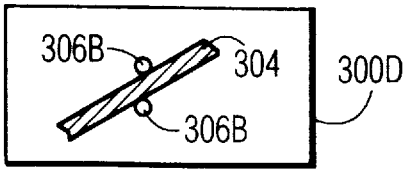

FIGS. 11A–11D show how the two-part former of FIG. 10 may be more broadly constructed. As diagrammatically shown in block form, guide means on inner former 300A may comprise a groove 303 in which wire 302 is held (FIG. 11A), or projections 306A for holding such wire (FIG. 11B). Similarly, outer former 300B may comprise a groove 305 in which wire 304 is held (FIG. 11C), or projections 306B for holding such wire (FIG. 11D).

As an alternative to using the formers described above for maintaining specific positioning of the inner and outer wires of the inventive coil with respect to each other, the wires could be first wound about a temporary mold (not shown). For instance, the mold could comprise a cylindrical body having perhaps eight longitudinal slots completely through the cylindrical body, and extending from one end of such body to a position near, but not reaching, the other end of the body. Where such temporary mold is constructed to space the inner and outer wires from each other at cross-over points, the wires could be non-insulated; where the mold is constructed such that the wires press against each other at cross-over points, they would be insulated, for instance, with TEFLON-brand synthetic resin. Then, TEFLON-brand resin could be pressed against the wires from outside the wires and sintered to create a former (not shown) to hold the wires with respect to each other. The temporary mold would then be removed. Alternatively, the inner and outer wires could be wound onto a so-called greenstate TEFLON-brand synthetic resin pressed body, and the resulting assembly sintered to near theoretical density, not using a temporary mold. A greenstate body is made from a pressing or presintering operation of TEFLON-brand resin, for example, which occurs prior to the main sintering stage.

Figure 12:
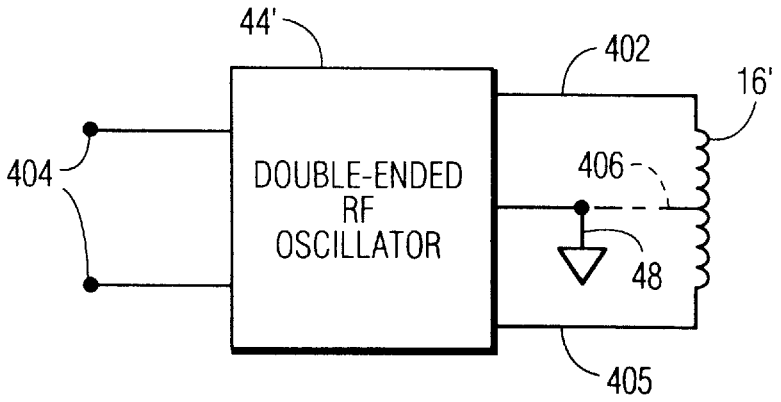
FIG. 12 shows an alternative RF oscillator that can be used in the circuit of FIG. 2.

FIG. 12 shows an alternative RF oscillator 44' that can be used in the circuit of FIG. 2. Thus, nodes 404 may be connected to the circuit to the left of same-numbered nodes 404 in FIG. 2. Oscillator 44' is referred to as a double-ended oscillator because it provides oppositely poled voltages on lines 402 and 405, connected to the top and bottom of coil 16' respectively, with respect to RF ground 48. The center of coil RF 16' may be connected to RF ground 48 through a wire 406, shown in phantom. Alternatively, the center of coil 16' may be floating with respect to ground 48, in which case the wiring for forming coil 16' may be a single, continuous wire. Oscillator 44' may be preferably embodied with a push-pull topology, which is known per se in the art.

Figure 13:
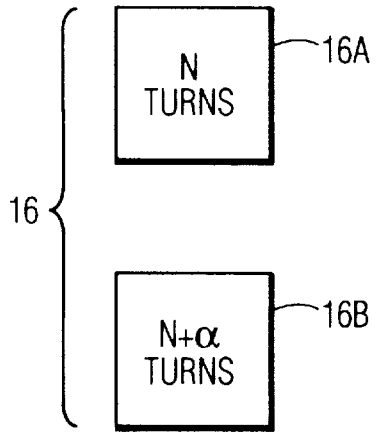
FIG. 13 is a block diagram view of a preferred modification of an RF coil.

When using the double-ended RF oscillator of FIG. 12, wire end 74B (FIG. 5) would be connected to line 405 (FIG. 12), rather than being left floating as when using the RF oscillator 44 of FIG. 2. If wire 406 (FIG. 12) is not used, wire ends 70A' and 74A' could be left floating with respect to ground FIG. 13 shows a block diagram view of an RF coil 16 comprising main coil winding 16A, e.g., winding 70 (FIG. 5), and a second (e.g. parasitic) winding 16B, e.g., winding 74 (FIG. 5). Not all inductance from main winding 16A will couple to secondary winding 16B, due to leakage inductance of the main winding. To compensate for this and assure that adjacent turns of windings 16A and 16B are approximately at the magnitude of voltage, secondary winding 16B can be provided with more turns than main winding 16A. Thus, as noted, main winding 16A has N turns, while second winding 16B has N+$\alpha$ turns. Determination of $\alpha$ is within the purview of those of ordinary skill in the art based on the present specification. The extra turns on the second wire are preferably distributed along the length of the coil, so that the two windings begin and end at the same position lengthwise along the coil.

While the invention has been described with respect to specific embodiments by way of illustration, many modifications and changes will occur to those skilled in the art. For instance, while the inner and outer winding layers of the inventive coil could be interchanged in their connections to the driving circuit of FIG. 2, whereby, for instance, outer wire 70 in FIG. 5 could be a parasitic wire, and wire 74 of FIG. 5 the active (non-parasitic) wire. It is, therefore, to be understood that the appended claims are intended to cover all such modifications and changes as fall within the true scope and spirit of the invention.

What is claimed is:

1. An electrodeless gas discharge lamp, comprising:

(a) a vitreous envelope containing a discharge medium;

(b) an excitation coil positioned in relation to said vitreous envelope so as to excite said discharge medium therein; said excitation coil adapted to be driven by an RF oscillator;

(c) said excitation coil having first and second ends and being effective for exciting said discharge medium to emit light with electromagnetic fields that are generated by said excitation coil;

(d) said excitation coil comprising:

(i) a first wire wound generally helically from said first end to said second end in a first helical direction to form first winding turns; and (ii) a second wire wound generally helically from said first end to said second end in a second helical direction opposite to that of said first helical direction to form second winding turns;

(e) said RF oscillator including a pair of output terminals having oppositely poled voltages with respect to the potential of an RF common node;

(f) respective portions of said first and second wires connected so as to be at one end of said coil being at the same potential as each other; and (g) respective ends of said first and second wires at another end of said coil being connected between said pair of oppositely poled output terminals.

2. An electrodeless gas discharge lamp, comprising:

(a) a vitreous envelope containing a discharge medium;

(b) an excitation coil positioned in relation to said vitreous envelope so as to excite said discharge medium therein; said excitation coil adapted to be driven by an RF oscillator; and (c) said excitation coil having first and second ends and being effective for exciting said discharge medium to emit light with electromagnetic fields that are generated by said excitation coil;

(d) said excitation coil comprising:

(i) a first wire wound generally helically from said first end to said second end in a first helical direction to form first winding turns; and (ii) a second wire wound generally helically from said first end to said second end in second helical direction opposite to that of said first helical direction to form second winding turns;

(e) the number of turns of the second wire exceeding the number of turns of said first wire with the extra turns of the second wire being distributed along the length of the coil to allow for the two windings to begin and end wire at the same position length wise along the coil so as to maintain the magnitude of the respective voltages on adjacent winding turns approximately the same.

3. The lamp of claim 1, wherein said discharge lamp comprises a low pressure discharge lamp.

4. An electrodeless gas discharge lamp, comprising:

(a) a vitreous envelope containing a discharge medium;

(b) an excitation coil positioned in relation to said vitreous envelope so as to excite said discharge medium therein; said excitation coil adapted to be driven by an RF oscillator; and (c) said excitation coil having first and second ends and being effective for exciting said discharge medium to emit light with electromagnetic fields that are generated by said excitation coil;

(d) said excitation coil comprising:

(i) a first wire wound generally helically from said first end to said second end in a first helical direction to form first winding turns; and (ii) a second wire wound generally helically from said first end to said second end in a second helical direction opposite to that of said first helical direction to form second winding turns; and (e) a generally cylindrical former for holding said first and second wires between said first and second ends of said coil, said former including positioning means for maintaining specific positions of said first and second wires with respect to each other along said former.

5. The lamp of claim 4, wherein said former so positions said first and second wires that respective portions of said wires which are at the same magnitude of voltage but 180° out-of-phase with each other are maintained at the same radial distance from an axial center of said former except for points in proximity to where said wires cross over each other.

6. The lamp of claim 4, wherein said positioning means comprises a first helical groove along an axial length of said former in which said first wire is positioned.

7. The lamp of claim 6, wherein said positioning means further comprises a second helical groove along an axial length of said former in which said second wire is positioned.

8. The lamp of claim 6, wherein said positioning means further comprises respective pairs of guide projections extending away from an interior of said former, and between which respective portions of said second wire are positioned.

9. The lamp of claim 4, wherein said positioning means comprises respective pairs of guide projections extending away from an interior of said former, and between which respective portions of said first wire ate positioned.

10. The lamp of claim 9, wherein said positioning means further comprises respective pairs of guide projections extending away from an interior of said former, and between which respective portions of said second wire are positioned.

11. The lamp of claim 4, wherein said former comprises an inner former portion around which said first wire is wound, and an outer former portion around which said second wire is wound and which is adapted to receive said inner former portion.

12. The lamp of claim 11, wherein said positioning means associated with said inner former portion comprises one of:

(a) respective pairs of guide projections extending away from an interior of said inner former portion; and (b) a helical groove along an axial length of said inner former portion in which said first wire is positioned.

13. The lamp of claim 12, wherein said positioning means associated with said outer former portion comprises one of:

(a) respective pairs of guide projections extending away from an interior of said outer former portion; and (b) a further helical groove along an axial length of said outer former portion in which said second wire is positioned.

14. The lamp of claim 4, wherein the number of turns of the first wire differs from the number of turns of said second wire so as to maintain the magnitude of the respective voltages on adjacent winding turns approximately the same.

15. The lamp of claim 4, wherein said discharge lamp comprises a low pressure discharge lamp.

16. The lamp of claim 4, wherein said former comprises magnetic material.

* * * * *